US007934850B2

(12) United States Patent
Altamura et al.

(10) Patent No.: US 7,934,850 B2
(45) Date of Patent: May 3, 2011

(54) DECORATIVE LIGHT DISPLAY

(75) Inventors: Steven J. Altamura, Scarsdale, NY (US); George Tsai, Hsinchu (TW)

(73) Assignee: Seasonal Specialties, LLC, Eden Prairie, MN (US)

( * ) Notice: Subject to any disclaimer, the term of this patent is extended or adjusted under 35 U.S.C. 154(b) by 216 days.

(21) Appl. No.: 12/208,775

(22) Filed: Sep. 11, 2008

(65) Prior Publication Data

US 2009/0015167 A1 Jan. 15, 2009

Related U.S. Application Data

(63) Continuation of application No. 11/583,997, filed on Oct. 18, 2006, now abandoned.

(51) Int. Cl.
*F21S 19/00* (2006.01)

(52) U.S. Cl. ..... 362/228; 362/234; 362/249.01; 40/549; 40/564

(58) Field of Classification Search ..... 362/252, 362/240, 800, 234, 84, 228, 249.01–249.06, 362/249.12, 249.14, 236; 315/165, 175; 40/550–551, 579, 553, 442–444, 564
See application file for complete search history.

(56) References Cited

U.S. PATENT DOCUMENTS

| | | | | |
|---|---|---|---|---|
| 4,890,000 | A | 12/1989 | Chou | |
| 5,107,408 | A | 4/1992 | Vernondier | |
| 5,124,903 | A | 6/1992 | Coviello | |
| 5,555,163 | A * | 9/1996 | Pisani | 362/244 |
| 5,575,098 | A | 11/1996 | Goettel-Schwartz | |
| 5,632,550 | A | 5/1997 | Yeh | |
| 6,386,368 | B1 | 5/2002 | Pirro | |
| 6,783,259 | B1 | 8/2004 | Macedonio | |
| 7,318,659 | B2 | 1/2008 | Demarest et al. | |
| 2002/0139808 | A1 | 10/2002 | Grueneberg | |
| 2004/0134832 | A1 | 7/2004 | Bluestein et al. | |
| 2004/0148825 | A1 | 8/2004 | Myers et al. | |
| 2006/0044796 | A1 * | 3/2006 | Wang et al. | 362/249 |
| 2006/0103320 | A1 | 5/2006 | Janning | |
| 2008/0037244 | A1 | 2/2008 | Hawkins et al. | |
| 2010/0135022 | A1 * | 6/2010 | Deguara | 362/249.06 |

* cited by examiner

*Primary Examiner* — Robert May
(74) *Attorney, Agent, or Firm* — Altera Law Group, LLC

(57) ABSTRACT

A decorative light display includes a plurality of light source assemblies, each respective light source assembly of the plurality of light source assemblies having a known power requirement and at least one power supply operably coupled to each respective light source assembly of the plurality of light source assemblies for supplying power from an external power source to each respective light source assembly of the plurality of light source assemblies, the at least one power supply providing power to each respective light source assembly, which power satisfies the known power requirement thereof. A method of displaying decorative lighting is further included.

16 Claims, 8 Drawing Sheets

DECORATIVE LIGHT DISPLAY

This application is a continuation of application Ser. No. 11/583,997, filed 18 Oct. 2006 now abandoned. The application is incorporated herein by reference.

TECHNICAL FIELD OF THE INVENTION

The present invention relates to lighting displays. More particularly, the present invention relates to displays for lighting and displaying decorative lights in a retail or commercial setting.

BACKGROUND OF THE INVENTION

Decorative light strings, especially those used for seasonal or holiday use, come in a variety of designs. Manufacturers and wholesalers offer a great variety of bulb shapes, bulb colors, string lengths, voltages, and so on. Retail sellers of decorative light strings typically rely on the packaging of the light string to convey the product features and qualities of the light string to potential purchasers. For example, many retailers package their light strings in boxes adorned with color photos of close-up views of the light strings, or scenes illustrating the use of the decorative light strings. However, even the use of high-quality graphical illustrations often fails to fully demonstrate the qualities and features of the light strings. This is especially true when introducing a new style bulb to the consuming public.

Retail sellers have long used electrified displays to showcase lighted Christmas trees, wreaths, and other large lighted ornamental products not typically sold in a package or box. On the other hand, retail sellers and their suppliers face a number of obstacles when it comes to displaying decorative lighting strings. For example, decorative light strings are often very long, and contain a large number of light sources, making it difficult to display an entire string, let alone display multiple strings. Light source voltages vary from light string to light string, making it difficult or even impossible to connect different bulb styles in a single string. The use of incandescent light sources and light emitting diode light sources further complicates the electrical requirements of any electrified display. Product displays also use up valuable shelf space normally dedicated to holding the decorative light strings themselves.

In addition to the physical and electrical obstacles preventing the easy display of a variety of decorative light strings in a single electrified display unit, safety must also be considered. Most decorative light strings are designed for 120V alternating current (AC) operation with the light sources electrically connected in series, or in series-parallel. To be most effective, a retailer would prefer to locate an electrified light display at shelf level near the packaged light strings. However, this leaves the electrified display accessible to potential buyers who might tamper with the display, resulting in a risk of electric shock or even fire.

Accordingly, a need exists in the industry for a simple electrified light display that allows decorative lights and bulbs in a variety of designs and voltages to be displayed in a single display unit, in an attractive, efficient and safe manner.

SUMMARY OF THE INVENTION

The present invention substantially meets the aforementioned needs of the industry by safely and efficiently providing an electrified decorative light display that can accommodate a variety of light sources representing a variety of decorative light strings. The display includes an enclosure, multiple light source groups, and one or more power supplies. Multiple light source assemblies form a light source group, with each light source assembly viewable in the decorative light display.

In one embodiment, light source assemblies operate on the same voltage and are constructed electrically in parallel to ensure that the failure of one light source assembly will not affect the operation of the other light source assemblies. In another embodiment, light source assemblies operate on the same voltage, and but are constructed in series-parallel, with a limited number of light source assemblies in a series block, so as to limit the disruption of power to other light source assemblies in the event of a failure of one light source assembly. The common operating voltage facilitates interchangeability of light assemblies based on availability of replacement assemblies. Although the shape, color, and general appearance of the light assemblies may change, the electrical characteristics of the light source assemblies do not change. Light source assemblies may include incandescent light sources, light emitting diode (LED) light sources, or other types of light sources.

The present invention includes a plurality of light source assemblies, each respective light source assembly of the plurality of light source assemblies having a known power requirement and at least one power supply operably coupled to each respective light source assembly of the plurality of light source assemblies for supplying power from an external power source to each respective light source assembly of the plurality of light source assemblies, the at least one power supply providing power to each respective light source assembly, which power satisfies the known power requirement thereof.

The wires connecting light assemblies within a single light source group may be relatively short compared to the wires connecting light source groups in order to minimize cost, weight and complexity of the display. A power supply isolates the source voltage having a relatively high voltage from the displayed light source assemblies and, in one embodiment, is a low voltage, low energy (LVLE) power supply, such as a Class 2 or Information Technology Equipment (ITE) power supply that reduces the source voltage to a lower alternating current (AC) or direct current (DC) voltage. The use of this type of power supply reduces the risk of electric shock and fire. In one embodiment, displays that use only incandescent light source assemblies or only LED assemblies may only require a single power supply. If the light display uses light source assemblies of differing voltages, voltage and/or current regulators may be used to deliver the appropriate power to light source assembly groups with different power requirements. In other embodiments, multiple power supplies with different output characteristics may be used to meet the power requirements of the light source assemblies.

The present invention is further a method of displaying decorative lighting.

DETAILED DESCRIPTION OF THE DRAWINGS

Figure 1:
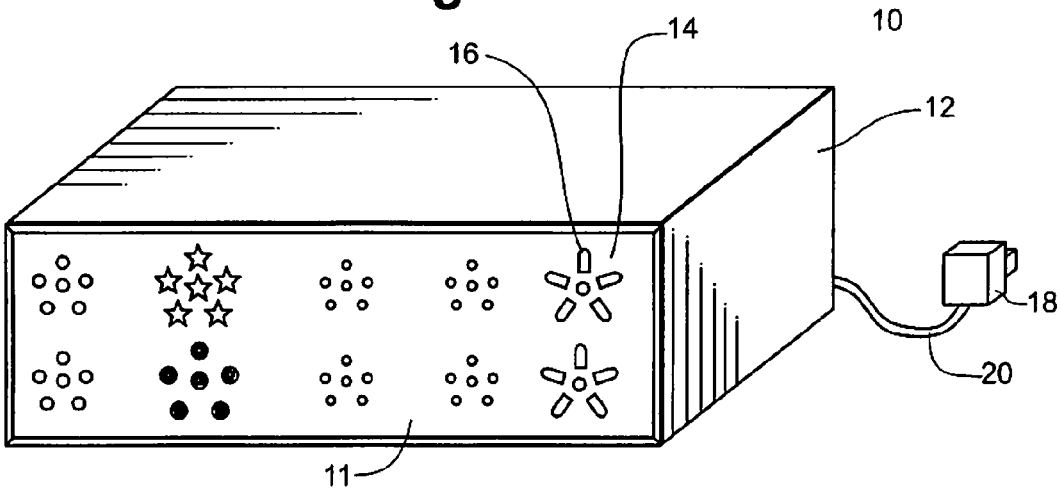
FIG. 1 is a perspective view of a horizontally-oriented decorative light display with incandescent light source assemblies displayed.

One embodiment of the decorative light display of the present invention is shown generally in FIG. 1. Decorative light display 10 includes an enclosure 12 with a front panel 11, plurality of light source groups 14, one or more power supplies 18, and power cord 20. Light source group 14 includes a plurality of light source assemblies 16 and decorative light display 10 may include any number of light source groups 14. In one embodiment, enclosure 12 and panel 11 are constructed of cardboard material and may include printed graphics and other printed information relevant to a potential light string buyer. Although in this embodiment the enclosure shape is generally depicted as rectangular and including front panel 1, those skilled-in-the-art will appreciate that the enclosure may be of any shape and configuration such that the light source assemblies are viewable in the enclosure.

Figure 1A:
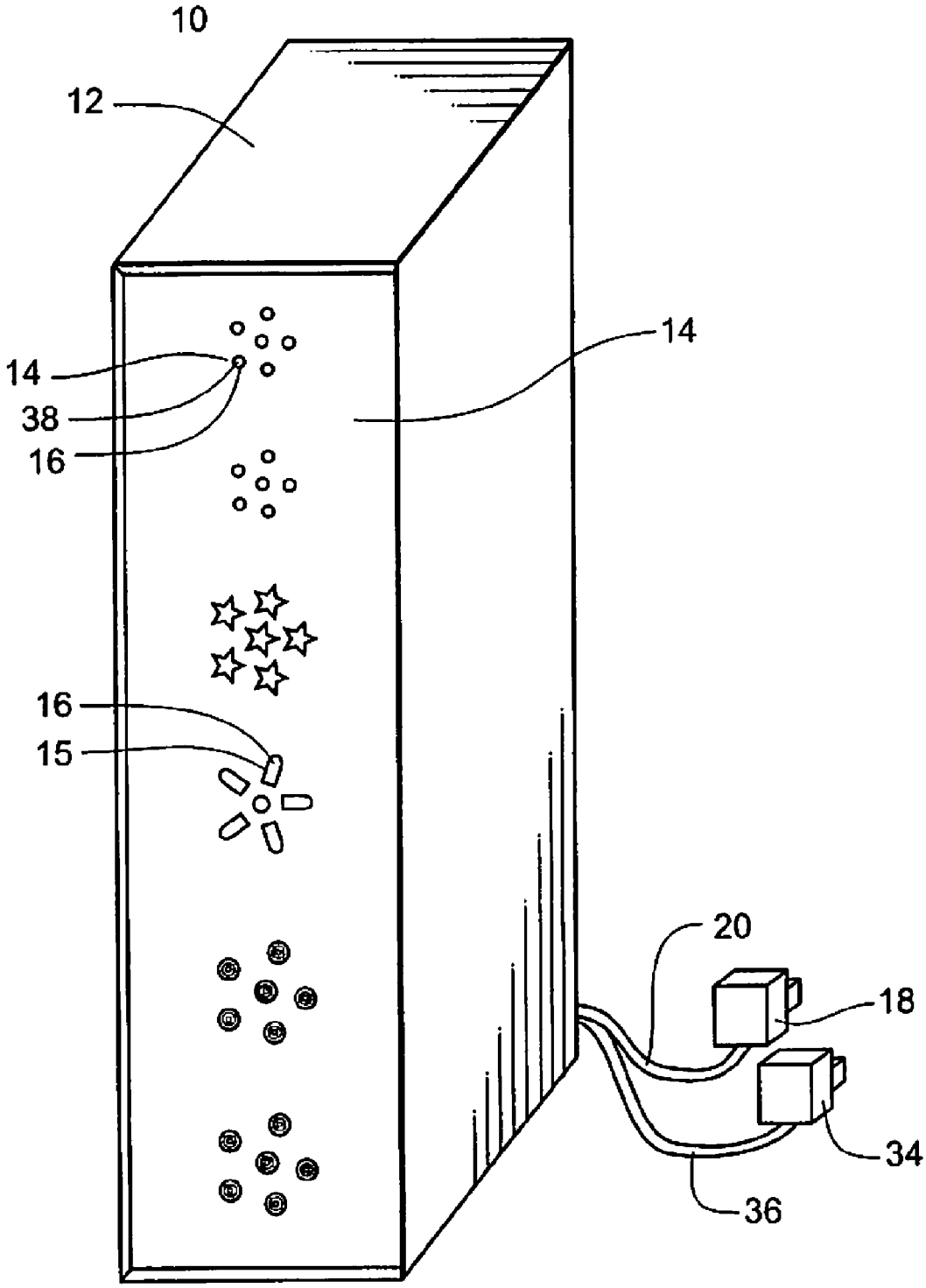
FIG. 1A is a perspective view of a vertically-oriented decorative light display with incandescent light source assemblies displayed.

While the embodiment shown in FIG. 1 illustrates light display 10 as a horizontally-oriented light display, light display 10 may alternatively be a vertically-oriented light display as illustrated in FIG. 1A.

Figure 2:
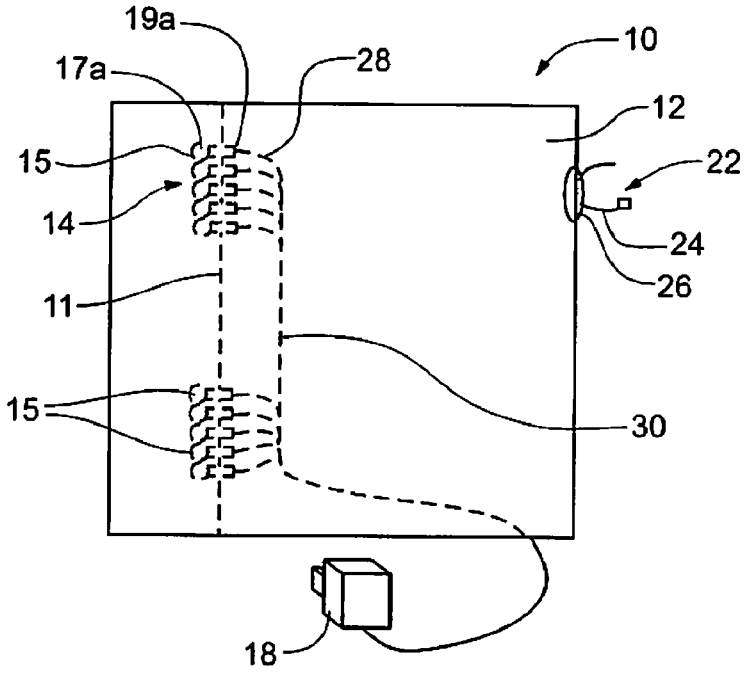
FIG. 2 is a side view of the decorative light display.
Figure 5:
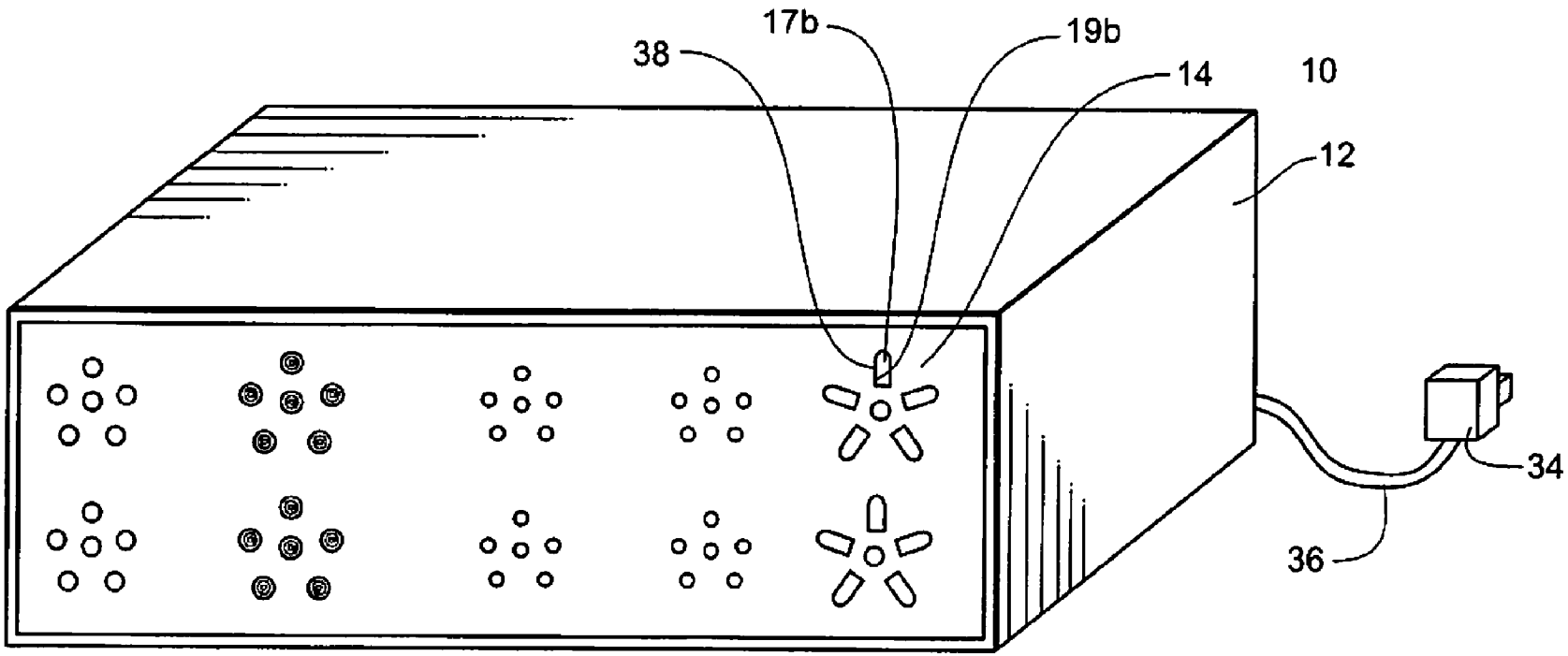
FIG. 5 is a perspective view of the decorative light display with LED light source assemblies displayed.

Light source assemblies 16 may be incandescent light source assemblies 15 as shown in FIG. 2, LED light source assemblies 38 as shown in FIG. 5, or other light source assemblies such as electroluminescent light source assemblies. Light source assemblies 15 and 38 include base portions 19*a* and 19*b*, and bulb assembly portions 17*a* and 17*b*, respectively. The bulb assembly portions 17*a, b* may utilize bulbs or covers made from glass, plastic or other materials in a variety of shapes and sizes. In one embodiment, all incandescent light source assemblies 15 operate on approximately the same voltage, and all LED light source assemblies 38 operate on approximately the same voltage. The operating voltage of incandescent light source assemblies 15 may differ from the operating voltage of LED light source assemblies 38. In other embodiments, the operating voltages and currents may vary from light group to light group within a single display 10.

In one embodiment, power supply 18 is an LVLE power supply, such as a Class 2 power supply or an ITE power supply, that reduces a 120 VAC source voltage to a lower voltage such as 12 VAC. Using a LVLE power supply isolates the higher source voltage from light source groups 14 and limits available energy, thereby reducing the risk of shock and fire. In other embodiments, power supply 18 may consist of other types of power supplies that reduce the source voltage, including those that output DC power, where DC power includes constant voltage DC, battery-sourced DC power, and full-wave or half-wave rectified AC power.

FIG. 2 shows a side view of one embodiment of decorative light display 10. Light source groups 14 are inserted through panel 11 such that much of light source assemblies 15 protrude through panel 11 and are visible when decorative light display 10 is viewed from the front. In other embodiments, light source assemblies 15 may be configured such that they do not protrude through panel 11, yet remain viewable within light display 10. Light source group wire set 28 consists of several wires 21 leading into light source group 14. Light source groups 14 are interconnected with interconnection wire set 30. Interconnection wire set 30 may consist of wires that are of greater length than the wires 21 of light source group wire sets 28. Making the wires 21 of light source group wire sets 28 relatively short in relation to the wire lengths of interconnection wire set 30 reduces the overall cost and weight of decorative light string display 10 and increases the ease of assembly of display 10.

Figure 3:
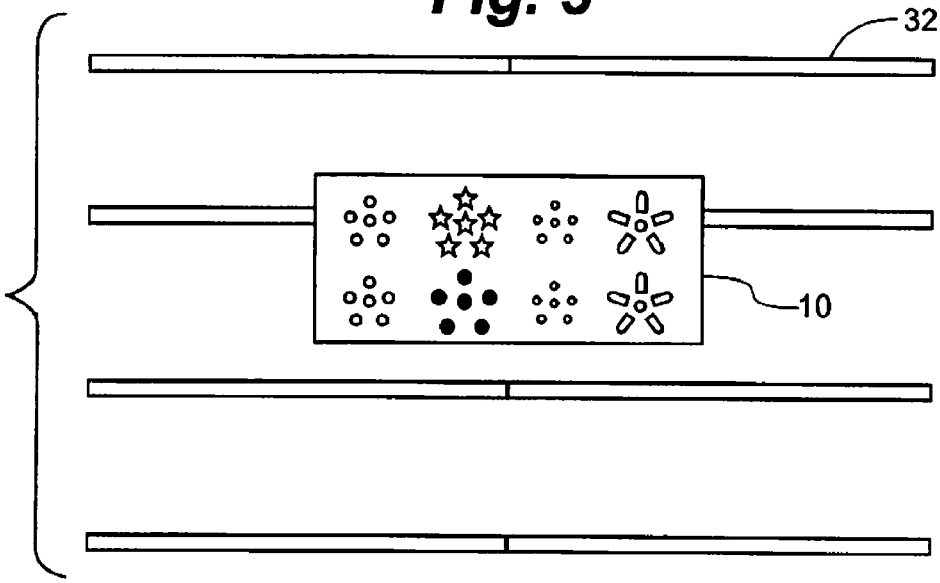
FIG. 3 is a front view of the decorative light display mounted to a shelf.

As shown in FIG. 2, display 10 also includes shelf connector 22. In one embodiment, shelf connector assembly 22 includes an adhesive-backed plate 26 that adheres to enclosure 12 and receives connector 24. Connector 24 may consist of any number of connectors including a nylon wire tie, a wire, string, or other type of connector that allows display 10 to be connected to a supporting structure, such as shelf 32, as shown in FIG. 3. In other embodiments, shelf connector assembly 22 may include self-tapping screws or other fasteners, may connect light display 10 to more than one shelf 32, and may not include adhesive-backed plate 26. In yet another embodiment, light display 10 may be a free-standing light display, and therefore not be connected to shelf 32 and not include shelf connector assembly 22.

Figure 4:
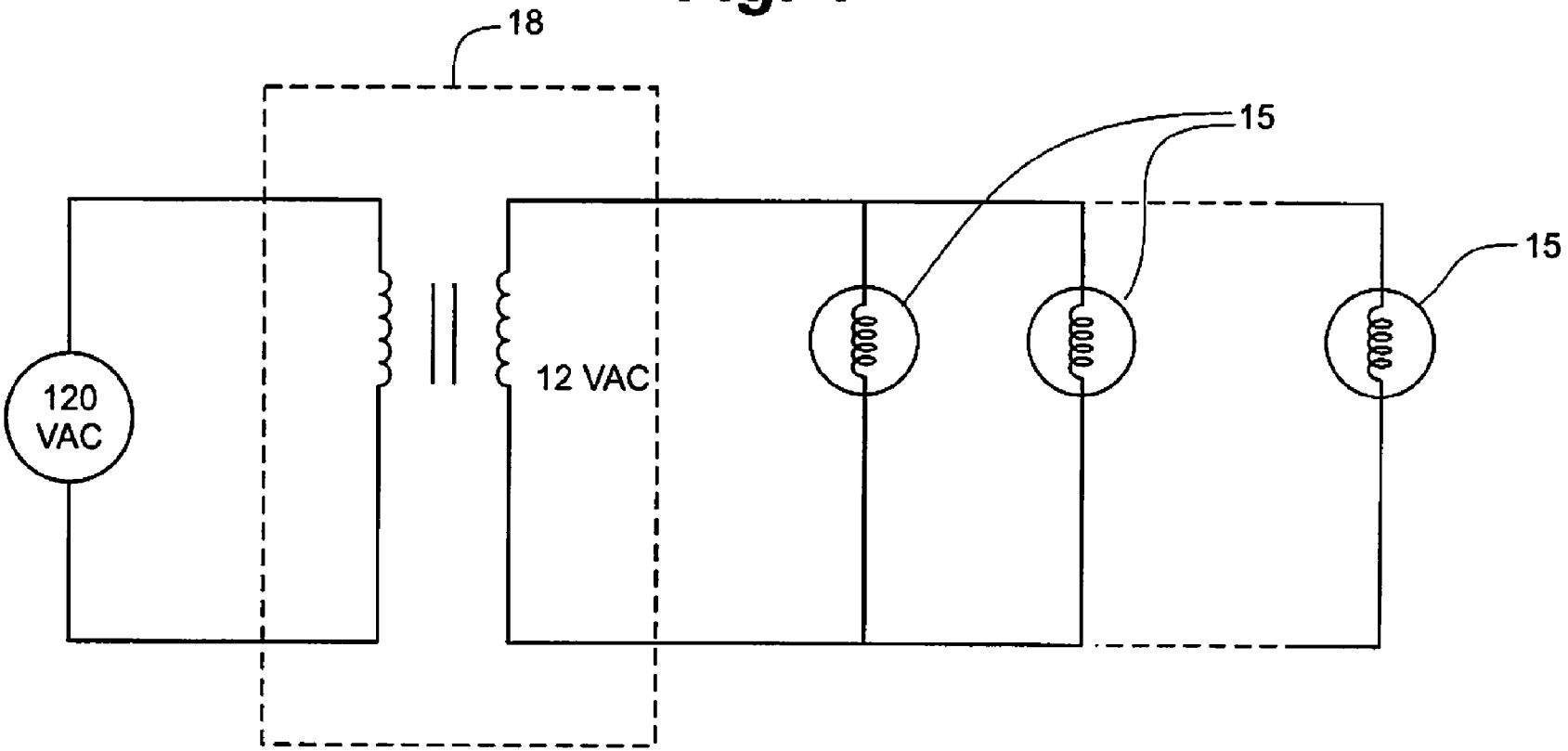
FIG. 4 is an electrical circuit diagram of the decorative light display with incandescent light source assemblies.

FIG. 4 is an electrical circuit diagram of display 10 where light source groups 14 include only incandescent light assemblies 15. In this embodiment, power supply 18 is an LVLE power supply that reduces incoming 120 VAC source voltage to 12 VAC. Although a typical decorative light string consists of incandescent bulbs connected in series blocks, often with thirty-five or more incandescent bulbs, the incandescent light assemblies 15 of this embodiment of the present invention are connected in parallel and operate on 12 VAC. In some embodiments, power supply 18 may supply a voltage less than or greater than 12 VAC to accommodate incandescent light assemblies 15 that require other operating voltages. By connecting incandescent light source assemblies 15 in parallel, if one incandescent light source assembly 15 fails, the other light source assemblies 15 in display 10 will remain lit, unlike a typical series-connected decorative light string.

Another advantage of the parallel construction is that all light source assemblies 15 operate on the same voltage, allowing interchangeability of assemblies 15 in the event of a failure of any one of the light source assemblies 15. This means that light source assemblies 15 with different appearances, e.g., different colors and shapes, are actually interchangeable. For example, a pearl-shaped light assembly may be connected in parallel with a cylindrical traditional mini-bulb. This interchangeability of light assemblies 15 differs from the actual decorative light strings being sold. Typically, the operating voltage characteristics of prior art light source assemblies in a decorative light string of one shape bulb and bulb count differs from the operating voltage characteristic of light assemblies using a different shape bulb and bulb count. Using the previous example, a traditional pearl-shaped light assembly used in a decorative light string operates on 3.5V, whereas a traditional mini-bulb light assembly in a string with 50 or 100 light assemblies connected in series will operate on 2.5V, preventing interchangeability of light source assemblies.

In another embodiment, incandescent light assemblies 15 are connected in series-parallel, rather than a purely parallel connection. In the series-parallel embodiment, the failure of any one incandescent light assemblies 15 will interrupt current to the other light assemblies 15 in the series block, causing all the light assemblies 15 in the block to fail. For this reason, the number of light assemblies 15 employed in a single series block is minimized. For example, a series-parallel embodiment of the present invention may include five incandescent light assemblies 15 per series block.

In the embodiment shown in FIG. 5, decorative light display 10 includes enclosure 12, light source groups 14, LED light source assemblies 38, power supply 34 and power cord 36. In this embodiment, display 10 uses LED light source assemblies 38 instead of incandescent light source assemblies 15 of the previously discussed embodiment. The number of LED light source assemblies 38 may be varied according to space requirements, desired lighting effect, and other requirements. Power supply 34 receives power from an external source voltage and supplies the appropriate power and voltage to LED assemblies 38.

Figure 6:
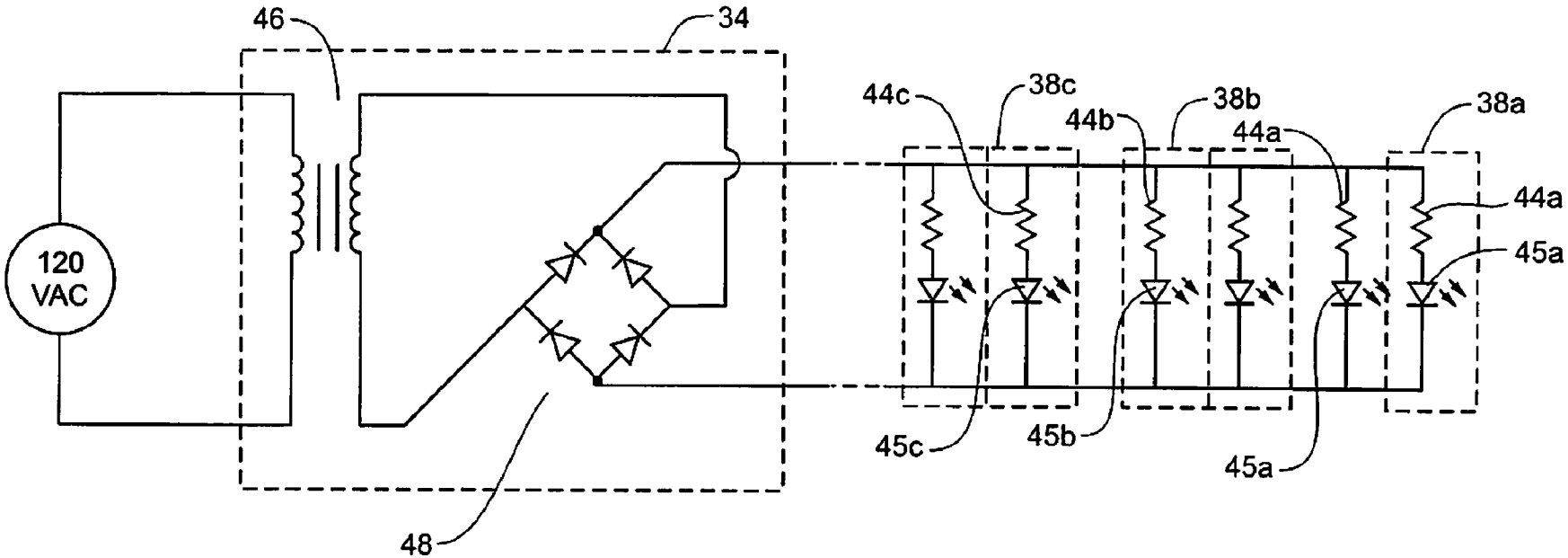
FIG. 6 is an electrical circuit diagram of the decorative light display using LED light source assemblies.

FIG. 6 is an electrical circuit diagram of display 10 where light source groups 14 include only LED assemblies 38. In the embodiment shown in FIG. 6, power supply 34 is connected to a 120 VAC source. Power supply 34 is typically an LVLE power supply, such as a Class 2 power supply, that reduces source voltage to a lower AC or DC voltage. In this embodiment, power supply 34 reduces the 120 VAC source voltage to 6 VDC, and includes a transformer 46 and rectifier 48. In other embodiments, power supply 34 could supply other DC voltages to LED assemblies 38, and may provide half-wave, full-wave, or other rectification of the incoming source voltage, and may or not include capacitors. In the embodiment shown in FIG. 6, the conversion from AC to DC takes place in an externally located power supply, however, in other embodiments, the conversion from AC to DC could occur within enclosure 12.

Figure 6A:
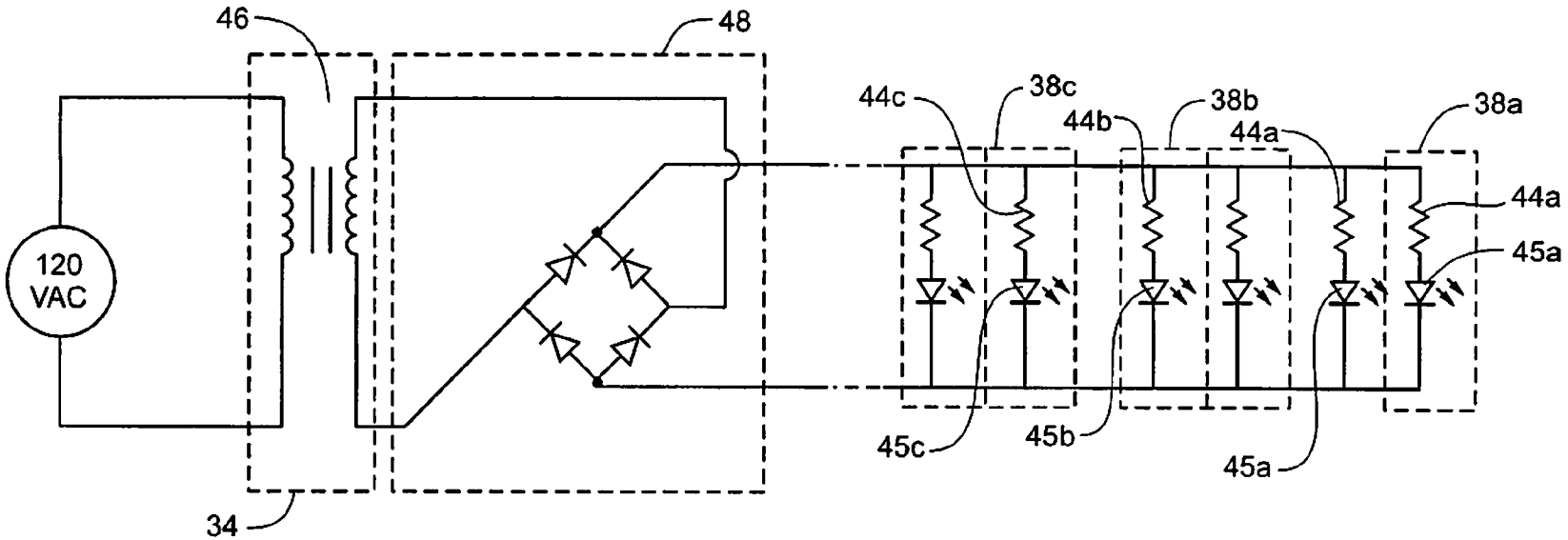

In the embodiment of FIG. 6A, power supply 34 does not include internal rectification. In this embodiment, rectification circuitry, for example rectifier 48, is located within light display 10, external to power supply 34.

As also shown in FIGS. 6 and 6A, each LED assembly 38 includes an LED 45 and may include a resistor 44. Resistor 44 may be located in either the base portion 19*b*, the bulb portion 17*b*, or in the wire (not shown). The value of the resistor is selected to drop the voltage supplied by power supply 34 to the operating voltage and current required by LED 45. The operating voltages and currents of LEDs 45 typically vary by color and manufacturer. In the embodiments illustrated in FIGS. 6 and 6A, LED's 45*a* require different operating voltages than LEDs 45*b* and 45*c*. As such, resistors 44*a* vary in value or magnitude from resistors 44*b* and 44*c*. The ability to vary the resistor values of resistors 44 allows the display of many kinds of LEDs 45 in light display 10 while using a single power supply 34. In this embodiment, all LED assemblies 38 are wired in parallel. However, in an alternate embodiment, LED assemblies 38 may also be wired in series-parallel blocks, similar to the way that the incandescent light assemblies 15 discussed above were alternatively wired in series-parallel blocks.

Figure 7:
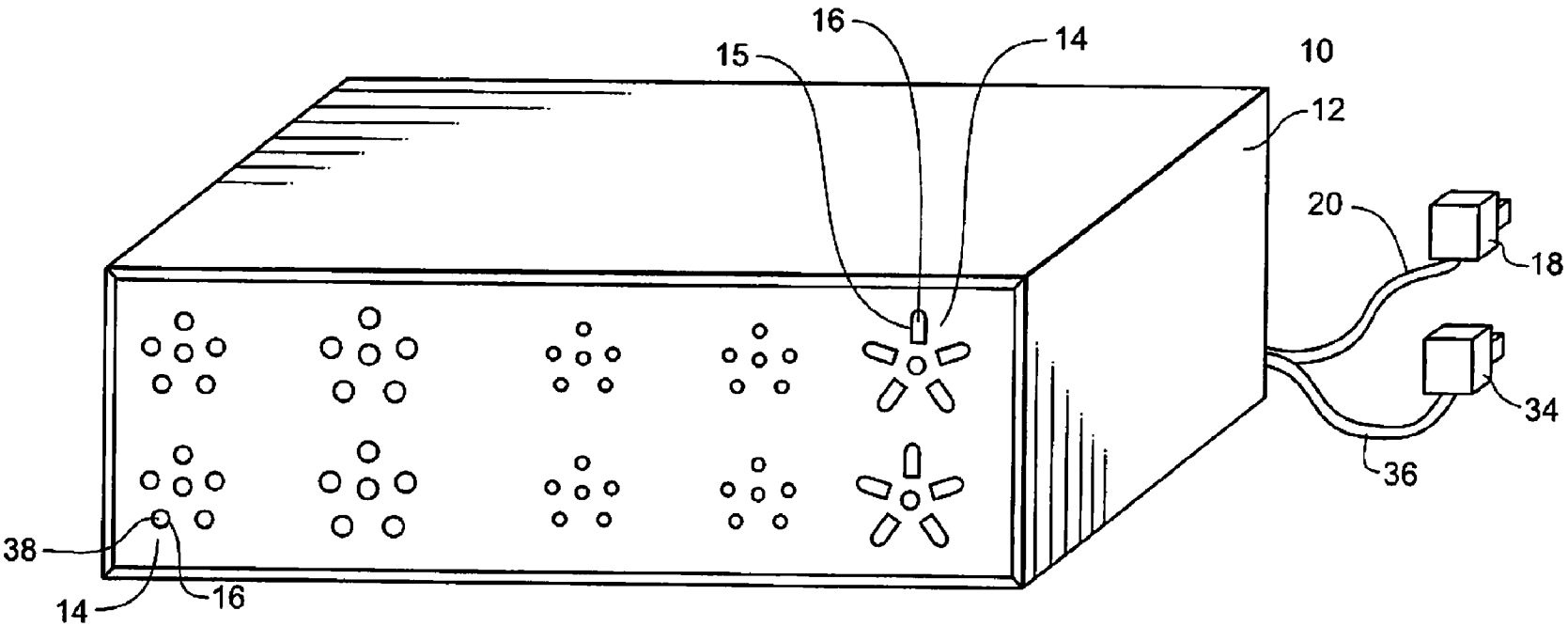
FIG. 7 is a perspective view of the decorative light display with both LED light source assemblies and incandescent light source assemblies displayed.

FIG. 7 is a perspective view of a decorative light string display 10 that utilizes both LED light source assemblies 38 and incandescent light source assemblies 15. In this embodiment, power supply 34 and power cord 36 provide the appropriate AC or DC power to LED assemblies 38, while power supply 18 and power cord 20 supply the appropriate AC or DC power to incandescent light assemblies 15.

The invention may be embodied in other specific forms without departing from the spirit of the essential attributes thereof. Therefore, the illustrated embodiments should be considered in all respects as illustrative and not restrictive.

What is claimed is:

1. A decorative light in-store display comprising:

a display box having a front face and sidewalls;

a plurality of light source assemblies contained within the box, each respective light source assembly of the plurality of light source assemblies having a plurality of lights connected in parallel with each other and having a known power requirement; and at least one power supply separately coupled to each respective light source assembly of the plurality of light source assemblies for supplying power from an external power source to each respective light source assembly of the plurality of light source assemblies, the at least one power supply providing power to each respective light source assembly, the power satisfying the known power requirement thereof; and a plurality of apertures in said front face, said apertures being grouped in to subgroups of apertures spaced apart from other subgroups, said apertures being sized to receive lights and wherein each subgroup receives lights from a single light source assembly so that particular features of such grouped lights are highlighted in each subgroup.

2. The decorative light display of claim 1 including a plurality of light source groups, each light source group including a plurality of light source assemblies, the light source assemblies included in a respective light source group being in electrical communication with one another and the respective light source groups being in electrical communication with one another and wherein said aperture subgroups each include a central aperture and a pluralities of aperture circumferentially surrounding the central aperture.

3. The decorative light display of claim 1 further comprising a shelf-connector assembly and wherein said aperture subgroups each include a central aperture and a pluralities of aperture circumferentially surrounding the central aperture in a star-like pattern.

4. The decorative light display of claim 1 wherein the at least one power supply includes at least one low voltage, wherein said aperture subgroups each include a central aperture and a pluralities of aperture circumferentially surrounding the central aperture and wherein only the light protrudes through the aperture.

5. The decorative light display of claim 4 wherein the power supply supplies AC power to each selected light source assembly.

6. The decorative light display of claim 1 wherein said aperture subgroups each include a central aperture and a pluralities of aperture circumferentially surrounding the central aperture and wherein the lights include a light bulb and a base, so that a viewer can see a plurality of lights in one display box.

7. The decorative light display of claim 1 further comprising a voltage regulator.

8. The decorative light display of claim 1 wherein the display box is affixed to a display rack by a shelf connector including a locking band.

9. The decorative light display of claim 1 wherein the lights protruding through said apertures in the plurality of subgroups are of a different style in different subgroups.

10. The decorative light display of claim 1 wherein the display box is affixed to a peripheral edge of a store shelf so that it is suspended therefrom.

11. The decorative light display of claim 10 wherein said box includes a shelf connection attached at the rear thereof, so that the box is suspended in front of the store shelf.

12. The decorative light display of claim 1 wherein the light source assemblies comprising the plurality of light source assemblies are connected electrically in a parallel configuration and wherein each assembly is supplied with power from separate power supplies so that the failure or removal of any light or power supply will not interrupt the remaining lights.

13. The decorative light display of claim 1 wherein said aperture subgroups each include a central aperture and a pluralities of aperture circumferentially surrounding the central aperture in a star pattern and wherein the lights include a light bulb and a base, so that a viewer can see a plurality of lights in one display box.

14. A method of displaying decorative lighting in a display box that includes the steps of:

wiring a plurality of lights in parallel into a light source assembly;

providing a plurality of light source assemblies and providing each respective light source assembly of the plurality of light source assemblies with a known power requirement;

operably coupling at least one power supply to each respective light source assembly of the plurality of light source assemblies for supplying power from an external power source to each respective light source assembly of the plurality of light source assemblies, and providing power to each respective light source assembly by means of the at least one power supply and thereby satisfying the known power requirement thereof;

grouping the lights from each light source assembly into a subgroup providing a plurality of grouped apertures in a front face of the display box, the grouped apertures being grouped into discrete subgroups spaced from each other and each subgroup having a central aperture and a plurality of circumferential apertures disposed around the central aperture; and inserting at least some of the lights of each light source assembly through the apertures of each subgroup, so that a viewer can compare different light groups.

15. The method of claim 14 including providing a plurality of light source groups and including a plurality of light source assemblies in each light source group;

electrically communicating the light source assemblies included in a respective light source group with one another, and;

electrically communicating the respective light source groups with one another.

16. The method of claim 14 further including the step of converting a supply voltage either to reduced direct current voltage or to a reduced alternating current voltage.

* * * * *